US010061343B2

(12) United States Patent
Fredrickson et al.

(10) Patent No.: US 10,061,343 B2
(45) Date of Patent: Aug. 28, 2018

(54) MOTION COUPLING OF MULTIPLE ELECTRONIC CONTROL INPUTS

(71) Applicant: Caterpillar SARL, Geneva (CH)

(72) Inventors: Andrew Arnold Fredrickson, Holly Springs, NC (US); Christopher M. Elliott, Apex, NC (US)

(73) Assignee: Caterpillar SARL, Geneva (CH)

( * ) Notice: Subject to any disclaimer, the term of this patent is extended or adjusted under 35 U.S.C. 154(b) by 194 days.

(21) Appl. No.: 15/250,226

(22) Filed: Aug. 29, 2016

(65) Prior Publication Data

US 2018/0058039 A1 Mar. 1, 2018

(51) Int. Cl.

| | |
|---|---|
| ***G05G 5/05*** | (2006.01) |
| ***E02F 9/20*** | (2006.01) |
| ***G05G 1/04*** | (2006.01) |
| ***G05G 5/06*** | (2006.01) |
| *E02F 3/34* | (2006.01) |

(52) U.S. Cl.

CPC ..... *G05G 5/05* (2013.01); *E02F 9/2004* (2013.01); *G05G 1/04* (2013.01); *G05G 5/06* (2013.01); *E02F 3/3414* (2013.01); *G05G 2505/00* (2013.01)

(58) Field of Classification Search

CPC ..... E02F 9/2004

See application file for complete search history.

(56) References Cited

U.S. PATENT DOCUMENTS

| | | | | |
|---|---|---|---|---|
| 5,042,314 | A * | 8/1991 | Rytter | B62D 1/12 180/333 |
| 5,953,196 | A * | 9/1999 | Zimmermann | G05G 5/12 307/101 |
| 6,637,311 | B2 * | 10/2003 | Barden | E02F 9/2004 74/471 XY |
| 6,648,352 | B2 | 11/2003 | Felsing et al. | |
| 7,139,621 | B2 * | 11/2006 | Gharsalli | G05G 9/047 700/72 |
| 7,530,185 | B2 * | 5/2009 | Trifunovic | E02F 3/432 172/2 |
| 7,650,810 | B2 | 1/2010 | Levin et al. | |
| 7,784,581 | B1 * | 8/2010 | Klas | E02F 9/166 180/329 |
| 8,066,567 | B2 | 11/2011 | Waggoner et al. | |

(Continued)

*Primary Examiner* — Nicole T Verley

(74) *Attorney, Agent, or Firm* — Miller, Matthias & Hull

(57) ABSTRACT

An electronic control system for controlling movement of a work machine is disclosed. The control system may include a first and a second joystick, each of the first and second joysticks configured to move between a neutral and an operational position. Moreover a first and second resistive device may be operatively coupled to the first and second joysticks respectively. The first and second resistive devices may be configured to generate a resistive force to selectively retain the first and second joysticks in the operational position. Additionally, the control system may include a controller in communication with the first and second joysticks and the first and second resistive devices. The controller may transmit a first and second resistive force signal to activate one of the first and second resistive devices to generate the resistive force such that one of the first and second joysticks is retained in the operational position.

20 Claims, 6 Drawing Sheets

(56) References Cited

U.S. PATENT DOCUMENTS

| | | | | |
|---|---|---|---|---|
| 8,380,402 | B2 * | 2/2013 | Hobenshield | G05G 9/04785 172/50 |
| 8,413,533 | B2 | 4/2013 | Rake et al. | |
| 8,607,657 | B2 | 12/2013 | Haevescher | |
| 8,807,263 | B2 * | 8/2014 | Caillieret | E02F 9/08 180/305 |
| 8,820,463 | B2 * | 9/2014 | Phillips | E02F 9/2004 180/272 |
| 9,004,218 | B2 | 4/2015 | Gulati et al. | |
| 9,074,352 | B2 * | 7/2015 | Ramun | E02F 3/301 |
| 9,777,461 | B2 * | 10/2017 | Wuisan | E02F 3/765 |
| 9,840,826 | B2 * | 12/2017 | Huber | E02F 9/2004 |
| 2013/0229272 | A1 * | 9/2013 | Elliott | G05G 9/047 340/407.2 |
| 2013/0248276 | A1 | 9/2013 | Chacko et al. | |
| 2015/0370254 | A1 | 12/2015 | Lee | |
| 2016/0146227 | A1 * | 5/2016 | Hoshaku | B62D 1/22 60/428 |
| 2016/0334830 | A1 * | 11/2016 | Sirohiwala | G01D 5/145 |
| 2017/0083039 | A1 * | 3/2017 | Wuisan | G05G 9/047 |
| 2018/0002893 | A1 * | 1/2018 | Heinzmann | E02F 9/2004 |
| 2018/0095492 | A1 * | 4/2018 | Matloff | G05G 9/047 |

* cited by examiner

MOTION COUPLING OF MULTIPLE ELECTRONIC CONTROL INPUTS

FIELD OF THE DISCLOSURE

The present disclosure relates generally to electronic control inputs and, more particularly, to motion coupling of a plurality of electronic control inputs.

BACKGROUND OF THE DISCLOSURE

Work machines, such as skid-steer loaders, track-type machines, excavators, bulldozers, on-road trucks, off-road trucks, and other such work machines are used in a variety of industries such as, construction, agriculture, and mining. Typically, work machines include multiple electronic control input devices such as, joysticks, levers, buttons, dials, wheels, and pedals, which are configured to control and perform various work machine operations. For example, the work machine may incorporate multiple electronic joysticks configured to move the machine forward and rearward, and provide turning and other maneuvering capabilities in a variety of directions. Additionally, the multiple electronic inputs may be configured to further control work tools and other implements that are attached to the work machine and configured to perform a variety of tasks.

In operation, the multiple electronic control input devices may work together in the control and operation of the work machine. For example, electronic joysticks may be one such input device used by an operator to control the movement of the work machine. Each electronic joystick may be actuated in a forward operational position to propel the work machine in a forward direction of travel and/or actuated in a rearward operational position to propel the work machine in a backwards direction of travel. Additionally, each electronic joystick may be actuated in differing amounts, in either the forward and rearward directions, to steer or otherwise maneuver the work machine.

When directing some work machines in the forward and/or rearward direction the operator may need to maintain each electronic joystick in the operational position to keep the work machine traveling along the desired path. In some situations, it may be desirable for the operator to have a free hand to attend to other operations and control devices of the work machine. Accordingly, there is a need for an electronic joystick control system for controlling joystick position such that when each joystick is actuated in the operational position the operator may release the hand control on one of the joysticks and the electronic control system will maintain the released joystick position.

An operating device for a shift-by-wire transmission is disclosed in U.S. Pat. No. 8,413,533 entitled, "Operating Device Having Force Feedback," (the '533 patent). The operating device is a lever rotatably coupled by a ball joint to a base of the transmission device. The '533 patent further includes a controllable counterforce element incorporating magnetorheological (MR) fluid and an actuator acting on the operating lever. The actuator provides active actuator-driven movement of the operating lever which automatically moves the operating lever into a certain lever position, for example automatically engaging the parking lock when the operator exits the vehicle. Furthermore, the MR fluid counterforce element is used to provide haptic feedback, or simulate the counterforces which a mechanical locking mechanism would produce in operation, while the actuator simulates the realistic return of the operating lever to the respective center positions of the locking mechanism when the operating lever is released.

While arguably effective, the '533 patent does not provide a control system of two operating devices that will allow the operator to release control of one operating device, while the control system maintains the position of the released operating device.

SUMMARY OF THE DISCLOSURE

In accordance with one embodiment, an electronic control system for controlling movement of a work machine is disclosed. The electronic control system may include a first joystick configured to move between a neutral position and an operational position about a first axis, and the first joystick may be further configured to transmit a first joystick position signal. A first resistive device may be operatively coupled to the first joystick and configured to generate a resistive force about the first axis to selectively retain the first joystick in the operational position in response to a first resistive force signal. The electronic control system may further include a second joystick configured to move between a neutral position and an operational position about a second axis, and the second joystick may be further configured to transmit a second joystick position signal. A second resistive device may be operatively coupled to the second joystick and configured to generate a resistive force about the second axis to selectively retain the second joystick in the operational position in response to a second resistive force signal. The electronic control system may include an electronic controller in electronic communication with the first and second joysticks and the first and second resistive devices. The electronic controller may be configured to receive the first and second joystick position signals and transmit one of the first and second resistive force signals in response to the first and second joystick position signals. The transmitted one of the first and second resistive force signals may activate one of the first and second resistive devices to generate a resistive force such that one of the first and second joysticks is retained in the operational position.

In accordance with another embodiment, a work machine is disclosed. The work machine may include a frame, a power source supported by the frame, and a plurality of ground engaging members configured to support the frame. The ground engaging members may be operatively coupled to the power source and configured to move the work machine. The work machine may further include an electronic control system operatively coupled to the plurality of ground engaging elements for controlling a movement of the work machine. The electronic control system may include a first joystick configured to move between a neutral position and an operational position about a first axis, and the first joystick may be further configured to transmit a first joystick position signal. A first resistive device may be operatively coupled to the first joystick and configured to generate a resistive force about the first axis to selectively retain the first joystick in the operational position in response to a first resistive force signal. The electronic control system may further include a second joystick configured to move between a neutral position and an operational position about a second axis, and the second joystick may be further configured to transmit a second joystick position signal. A second resistive device may be operatively coupled to the second joystick and configured to generate a resistive force about the second axis to selectively retain the second joystick in the operational position in response to a second resistive force signal. The electronic control system may include an electronic controller in electronic communication with the first and second joysticks and the first and second resistive devices. The electronic controller may be configured to receive the first and second joystick position signals and transmit one of the first and second resistive force signals in response to the first and second joystick position signals. The transmitted one of the first and second resistive force signals may activate one of the first and second resistive devices to generate a resistive force such that one of the first and second joysticks is retained in the operational position.

In accordance with yet another embodiment, a method of controlling movement of a work machine is disclosed. The method may include applying an actuating force to a first joystick about a first axis and a second joystick about a second axis thereby moving the first and second joysticks from a neutral position to an operational position. The method may further include transmitting a first joystick position signal from the first joystick and a second joystick position signal from the second joystick to an electronic controller. The method may include receiving by the electronic controller the first joystick position signal and the second joystick position signal, and transmitting a first resistive force signal to a first resistive device and a second resistive force signal to a second resistive device from the electronic controller in response to the first and second joystick position signals. The method may further include activating one of the first and second resistive devices with the resistive force signal to generate a resistive force such that one of the first and second joysticks is retained in the operational position by one of the first and second resistive devices in response to one of the first and second resistive force signals.

DETAILED DESCRIPTION

Figure 1:
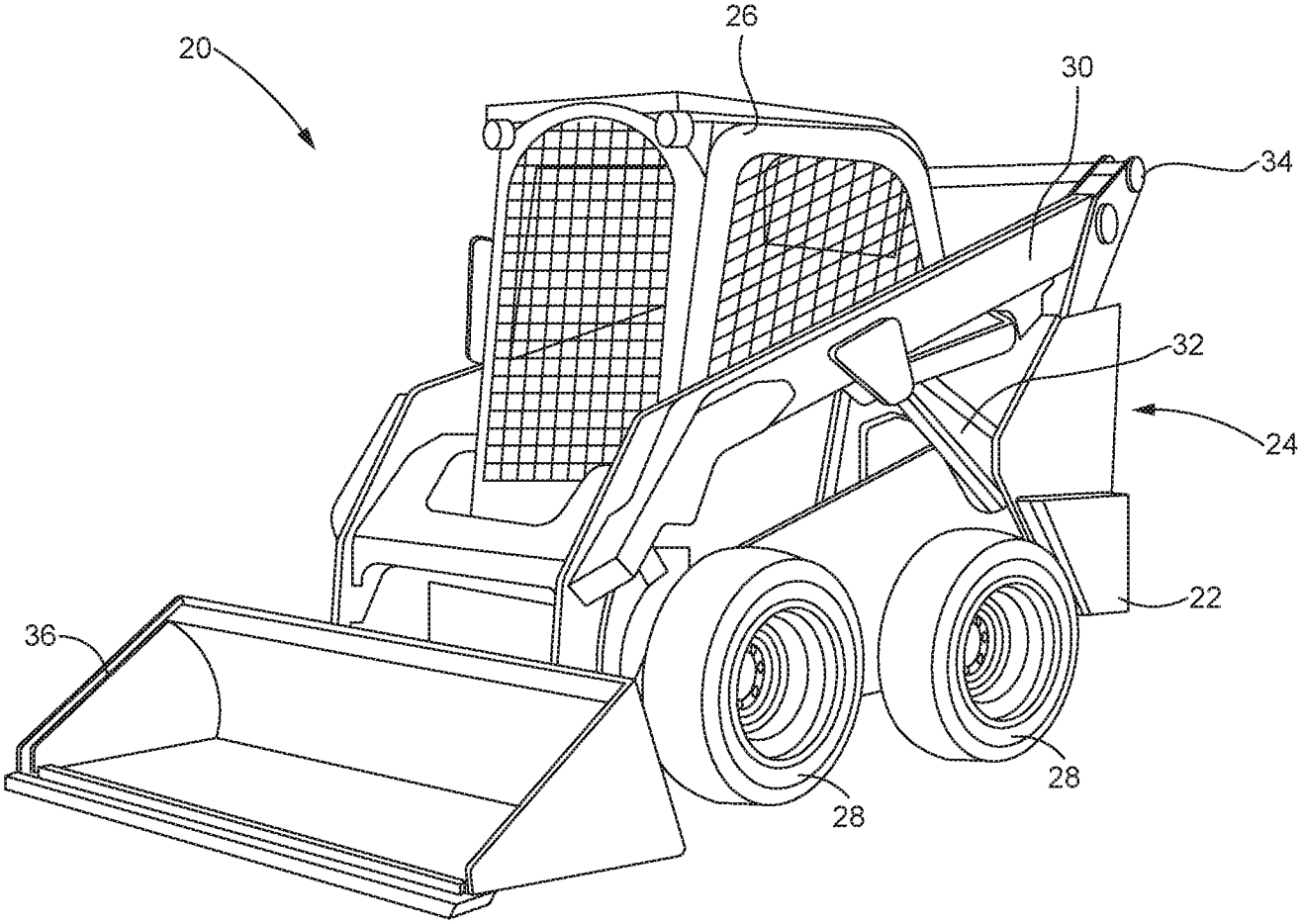
FIG. 1 is a perspective side view of a work machine, in accordance with an embodiment of the present disclosure.

Referring now to the drawings and with specific reference to FIG. 1, a work machine 20 is shown, in accordance with certain embodiments of the present disclosure. It is to be understood that although the work machine 20 is illustrated as a skid-steer loader, the work machine 20 may be of any other type of machine. As used herein, the work machine 20 refers to a mobile machine that performs a driven operation involving physical movement associated with a particular industry, such as, but not limited to, earthmoving, construction, landscaping, transportation, forestry, agriculture, mining, etc.

Non-limiting examples of the work machine 20 include commercial and industrial machines, such as loaders, excavators, earth-moving vehicles, tractors, motor graders, dozers, backhoes, hauling machines, dump trucks, mining vehicles, on-highway vehicles, trains, agricultural equipment, material handling equipment, and other types of machines that operate in a work environment. It is to be understood that the work machine 20 is shown primarily for illustrative purposes to assist in disclosing features of various embodiments, and that FIG. 1 does not depict all of the components of a machine.

The work machine 20 may include a frame 22 that supports a power source 24 and an operator cab 26. The work machine 20 may further include a set of ground engaging members 28 that are rotatably connected to the frame 22 and driven by the power source 24 to propel the work machine 20 in a direction of travel. Although the set of ground engaging members 28 are shown as wheels, other types of traction devices, such as continuous tracks and the like, may be used. Additionally, the work machine 20 may include a lift arm 30 operatively coupled to the work machine 20. The lift arm 30 may be further coupled to one or more actuating cylinders 32. One end the lift arm 30 may be rotatably attached to the work machine 20 at a rotatable attachment point 34 such that an actuation of the one or more actuating cylinders 32 rotates the lift arm 30 about the rotatable attachment point 34 to raise, lower, or otherwise move the lift arm 30. Furthermore, the lift arm 30 may be coupled to a machine implement 36, such as, but not limited to, a bucket, a shovel, a hammer, or a drill. The lift arm 30 and the machine implement 36 may be configured to be moved into position by the one or more actuating cylinders 32 in order to carry out the desired task at hand.

Figure 2:
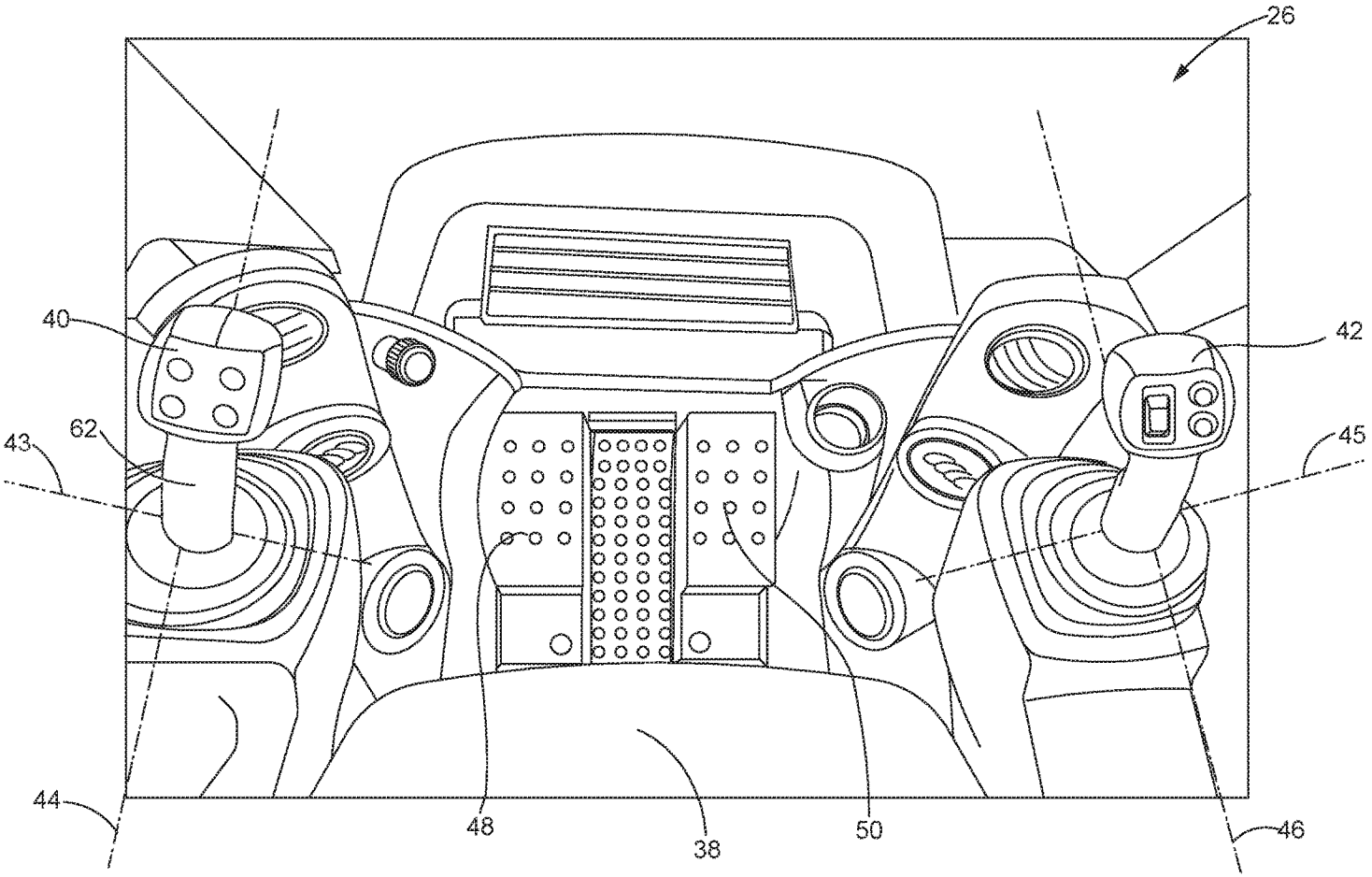
FIG. 2 is an enlarged, elevated top view of the operator cab of the work machine of FIG. 1, in accordance an embodiment of the present disclosure.

Referring now to FIG. 2, with continued reference to FIG. 1, an elevated top view of the operator cab 26 of the work machine 20 is shown. The operator cab 26 may include an operator station 38 that is configured for an operator of the work machine 20 to sit or stand while controlling and operating the work machine 20. However, in some embodiments, the work machine 20 may be configured to be operated remotely such that the operator controls and operates the work machine 20 from a location outside of the operator cab 26. In one non-limiting example, the operator cab 26 may be configured with a first joystick 40 and a second joystick 42, and the first and second joysticks 40, 42 may be arranged adjacent to the operator station 38. Furthermore, in one non-limiting arrangement, the first joystick 40 and the second joystick 42 are orientated such that the operator sitting in the operator station 38 may actuate the first joystick 40 with the left hand and the second joystick 42 with the right hand. However, the first and second joysticks 40, 42 may be positioned or arranged in alternative locations of the operator cab 26. Furthermore, while first and second joysticks 40, 42 are shown in FIG. 2, it is to be understood that an alternative number of joysticks may be included in the operator cab 26 as well.

In some embodiments, the first and second joysticks 40, 42 are operatively coupled to the ground engaging members 28 of the work machine 20 such that actuating the first and second joysticks 40, 42 controls the movement of the work machine 20 in a particular direction (i.e. forward, rearward, right, or left). The first and second joysticks 40, 42 may be configured such that the first joystick 40 (i.e., left joystick) controls the ground engaging members 28 on the left side of the work machine 20, and the second joystick 42 (i.e., right joystick) controls the ground engaging members 28 on the right side of the work machine 20. However, other configurations of the first and second joysticks 40, 42 are possible. Alternatively and/or additionally, the first and second joysticks 40, 42 may be configured to control other operations of the work machine 20, such as, but not limited to, operation of the lift arm 30, the actuating cylinders 32, the machine implement 36, or any other components or systems of the work machine 20.

As further shown in FIG. 2, the first joystick 40 may be configured to rotate about a first joystick axis 43 and move along a first joystick movement pathway 44 and the second joystick 42 may be configured to rotate about a second joystick axis 45 and move along a second joystick movement pathway 46. In one non-limiting example, the first and second joystick movement pathways 44, 46 are orientated such that the first and second joysticks 40, 42 are moveable in a longitudinal or forward and/or rearward direction. However, the first and second joystick movement pathways 44, 46 may be alternately configured to permit movement of the first and second joysticks 40, 42 in a lateral, or right and left direction. Moreover, in yet another embodiment, the first and second joysticks 40, 42 may be configured to move in multiple directions such that the first and second joysticks 40, 42 are capable of moving forward, rearward, right, left, or any other combination thereof.

The operator cab 26 may further include a first pedal 48 and a second pedal 50 movably configured to provide additional control of the work machine 20. For example, the first and second pedals 48, 50 may be depressed and/or released by the operator during the operation of the work machine 20. In some embodiments, the first and second pedals 48, 50 are operatively coupled to the one or more actuating cylinders 32 of the lift arm 30 and the machine implement 36 such that depressing and/or releasing each of the first and second pedals 48, 50 may cause the one or more actuating cylinders 32 to raise and/or lower the lift arm 30. Additionally, the first and second pedals 48, 50 may be configured to perform other functions of the work machine 20, such as tilt, or otherwise actuate the machine implement 36, control the throttle of the power source 24, operate the ground engaging members 28, or other known function.

Figure 3:
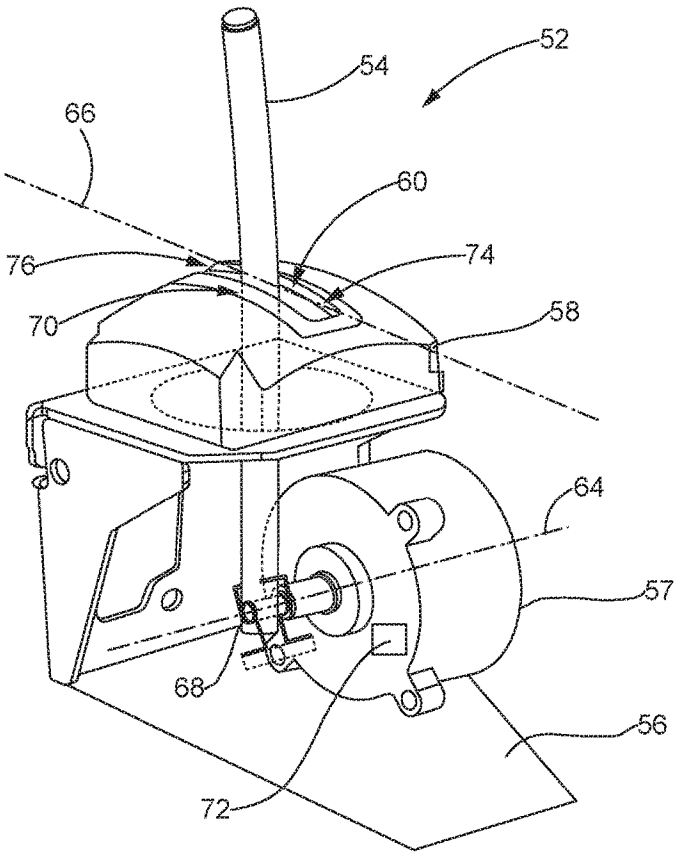
FIG. 3 is a perspective view of an electronic joystick assembly, in accordance with an embodiment of the disclosure.

Referring to FIG. 3, with continued reference to FIGS. 1-2, an electronic joystick assembly 52 is shown. In some embodiments, one or more electronic joystick assemblies 52 may be incorporated into the operator cab 26 and configured to control and operate the work machine 20. For example, the operator cab 26 of FIG. 2 includes two electronic joystick assemblies 52 configured to control and operate the work machine 20, illustrated by the first and second joysticks 40, 42. Furthermore, while the operator cab 26 shows the use of two electronic joystick assemblies 52 (i.e., first joystick 40 and second joystick 42), it will be understood that an alternative number and configuration of the electronic joystick assembly 52 are possible.

The electronic joystick assembly 52 may include a joystick shaft 54, a joystick base 56, a magnetorheological (MR) joystick device 57, and a joystick housing 58. Furthermore, the joystick shaft 54 may be rotatably coupled to the MR joystick device 57, and the joystick shaft 54 may be configured to extend vertically upwards from the MR joystick device 57 and exiting the joystick housing 58 through a housing aperture 60. Additionally, a portion of the joystick shaft 54 that exits the joystick housing 58 through the housing aperture 60 may be configured to include a joystick grip 62 or handle (FIG. 2) covering the joystick shaft 54. The joystick grip 62 provides an ergonomic surface for the operator of the work machine 20 to grasp while manipulating or otherwise actuating the electronic joystick assembly 52 during operation of the work machine 20.

The joystick shaft 54 is rotatably coupled to the MR joystick device 57 and therefore may be configured to rotate about the joystick assembly axis 64 along a joystick assembly movement pathway 66 when the joystick shaft 54 is moved or otherwise actuated by the operator of the work machine 20. In some embodiments, the electronic joystick assembly 52 is configured to move along the joystick assembly movement pathway 66 in the forward and rearward direction. However, the electronic joystick assembly 52 may be additionally and/or alternatively configured to move in other directions such as, left, right, or any other such direction. Moreover, in some embodiments, the housing aperture 60 may be configured to define the joystick assembly movement pathway 66. For example, the housing aperture 60 may be configured as a slot formed in the joystick housing 58. As a result, the housing aperture 60 may be configured to permit movement in the desired direction along a single pathway (i.e., forward/rearward). Additionally or alternatively, the electronic joystick assembly 52 may be configured to move in multiple directions and the joystick shaft 54 is configured to move forward, rearward, left, right, diagonally, or any other direction or combination thereof. Therefore, the housing aperture 60 may be alternately configured to direct movement of the joystick shaft 54 in multiple directions.

In some embodiments the MR joystick device 57 may be operatively coupled to the joystick shaft 54, and configured to provide a resistive force or holding force on the joystick shaft 54 and/or other components of the electronic joystick assembly 52. Furthermore, the MR joystick device 57 may be configured as a controllable resistive force actuator which includes an MR material configured to respond to the application a magnetic field. As a result, a magnetic field may be selectively applied to the MR joystick device 57 and the application of the magnetic field may alter the material properties of the MR joystick device 57, such as, but not limited to, increase and/or decrease the MR material viscosity. In some embodiments, the MR joystick device 57 is operatively coupled to the joystick shaft 54, and the MR joystick device 57 may be configured to selectively generate a resistive force on the joystick shaft 54 along the joystick assembly axis 64 such that the resistive force is capable of retaining the joystick shaft 54 in an articulated or operational position (i.e., forward or rearward). While use of the MR joystick device 57 is introduced here, it will be appreciated that other controllable resistive or holding mechanisms may be used to generate the resistive force to retain the joystick shaft 54 in the desired position. Additionally and/or alternatively, an MR device may be coupled with other input devices of the work machine 20, such as the first and second pedals 48, 50, to provide an additional and/or alternative resistive force or holding force on the other input devices.

Furthermore, the electronic joystick assembly 52 may include a joystick centering spring 68 that is operatively coupled to the joystick shaft 54. The joystick centering spring 68 may be configured to generate a return spring force which acts upon the joystick shaft 54 along the joystick assembly axis 64 during actuation or movement of the joystick shaft 54 such that the return spring force returns the joystick shaft 54 back towards a joystick neutral or joystick center position 70 following the removal of the actuation force acting on the joystick shaft 54. As a result, to maintain the joystick shaft 54 in the actuated or operational position, (i.e., forward or rearward) the resistive force generated by the MR joystick device 57 may be controlled to provide an adjustable torque or other such resistive force on the joystick shaft 54 that is greater than the opposing return spring force exerted on the joystick shaft 54 by the joystick centering spring 68. For example, the MR joystick device 57 may be configured to generate the resistive force to provide at least 2 newton meters (Nm) of torque on the joystick shaft 54 to oppose the return spring force generated by the joystick centering spring 68. However, it will be understood that the MR joystick device 57 may be controlled to provide the resistive force with an alternate amount of torque in accordance to the amount of return spring force that is generated by the joystick centering spring 68. Moreover, while the resistive force may be configured to be greater than the return spring force generated by the joystick centering spring 68, an operator will be able to intervene and override the resistive force during operation of the work machine 20, if needed.

The electronic joystick assembly 52 may further include a joystick position sensor 72 operatively coupled to the joystick shaft 54. In one non-limiting example, the joystick position sensor 72 may be incorporated with the MR joystick device 57. Alternatively or additionally, the joystick position sensor 72 may be positioned in an alternative location of the electronic joystick assembly 52. The joystick position sensor 72 is configured to provide a position of the joystick shaft 54 as it is moved between the joystick center position 70 and a joystick forward position 74 and/or a joystick rearward position 76. For example, the joystick position sensor 72, such as, but not limited to, an optical position sensor, a rotary encoder, a capacitive transducer, or other such position sensor, may be configured to provide a position signal of the joystick shaft 54 as it moves along the joystick assembly axis 64.

Figure 4:
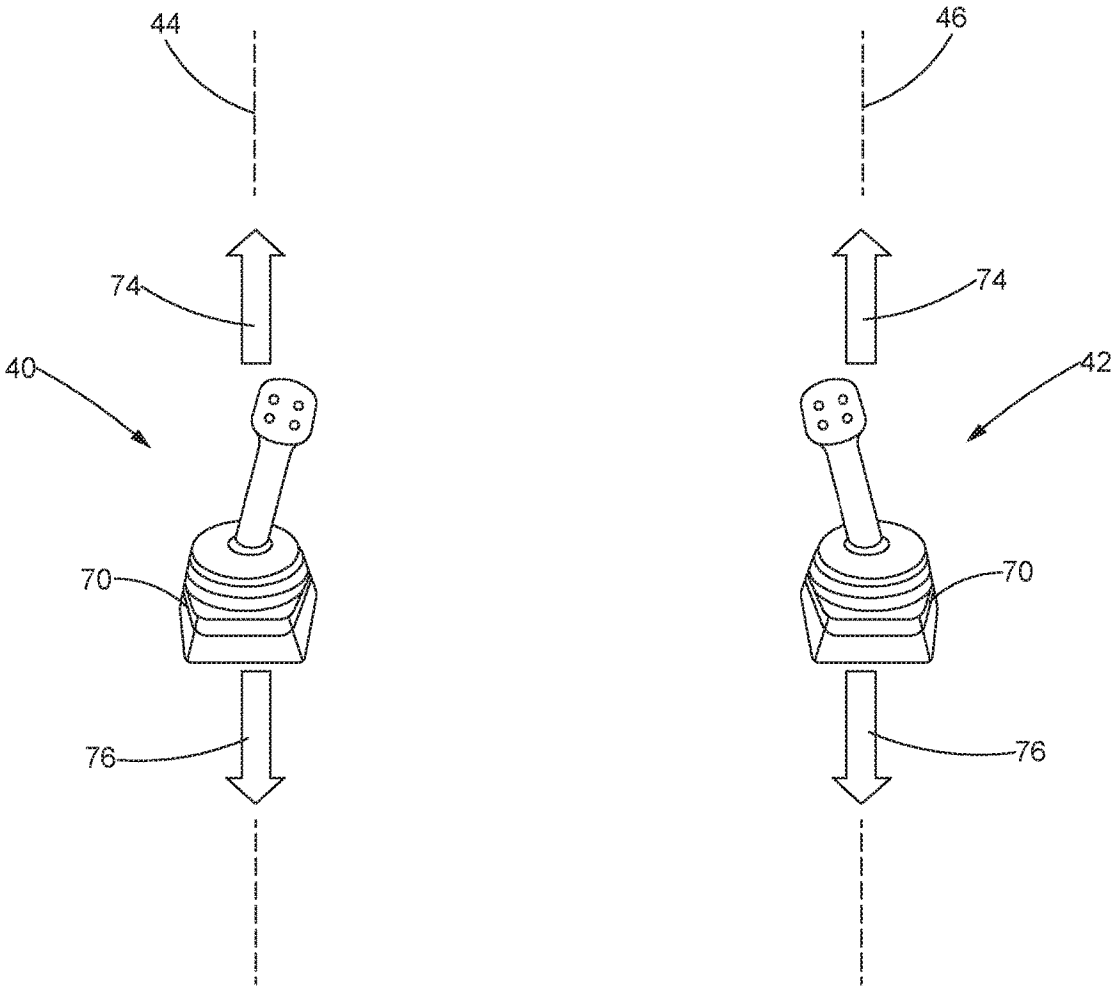
FIG. 4 is a schematic view of the first and second joysticks incorporated into the operator cab of FIG. 2, in accordance with an embodiment of the disclosure.

Referring to FIG. 4, with continued reference to FIGS. 1-3, an operational schematic of the first and second joystick 40, 42 is shown. As discussed above, the first and second joysticks 40, 42 may be configured to each include the electronic joystick assembly 52. Moreover, the first and second joysticks 40, 42 may be operatively coupled to the ground engaging members 28 of the work machine 20, and the first and second joysticks 40, 42 may be configured such that the first joystick 40 (i.e. left joystick), operates the ground engaging members 28 on the left side of the work machine 20, and the second joystick 42 (i.e., right joystick), operates the ground engaging members 28 on the right side of the work machine 20.

In one non-limiting example, the first and second joysticks 40, 42 are configured to move in the forward and rearward direction along the first joystick movement pathway 44 and the second joystick movement pathway 46 to propel the work machine 20 in a direction of travel. When the work machine 20 is not moving, or is in an idle state, each of the first and second joysticks 40, 42 is positioned at the joystick center position 70 (i.e., joystick neutral position). To propel the work machine 20 in a straight forward direction the operator may actuate each of the first and second joysticks 40, 42 an equal amount from the joystick center position 70 to the joystick forward position 74 (i.e., joystick operational position). Similarly, to propel the work machine 20 in a straight rearward direction the operator may actuate or pull each of the first and second joysticks 40, 42 an equal amount from the joystick center position 70 to the joystick rearward position 76 (i.e., joystick operational position).

Figure 5:
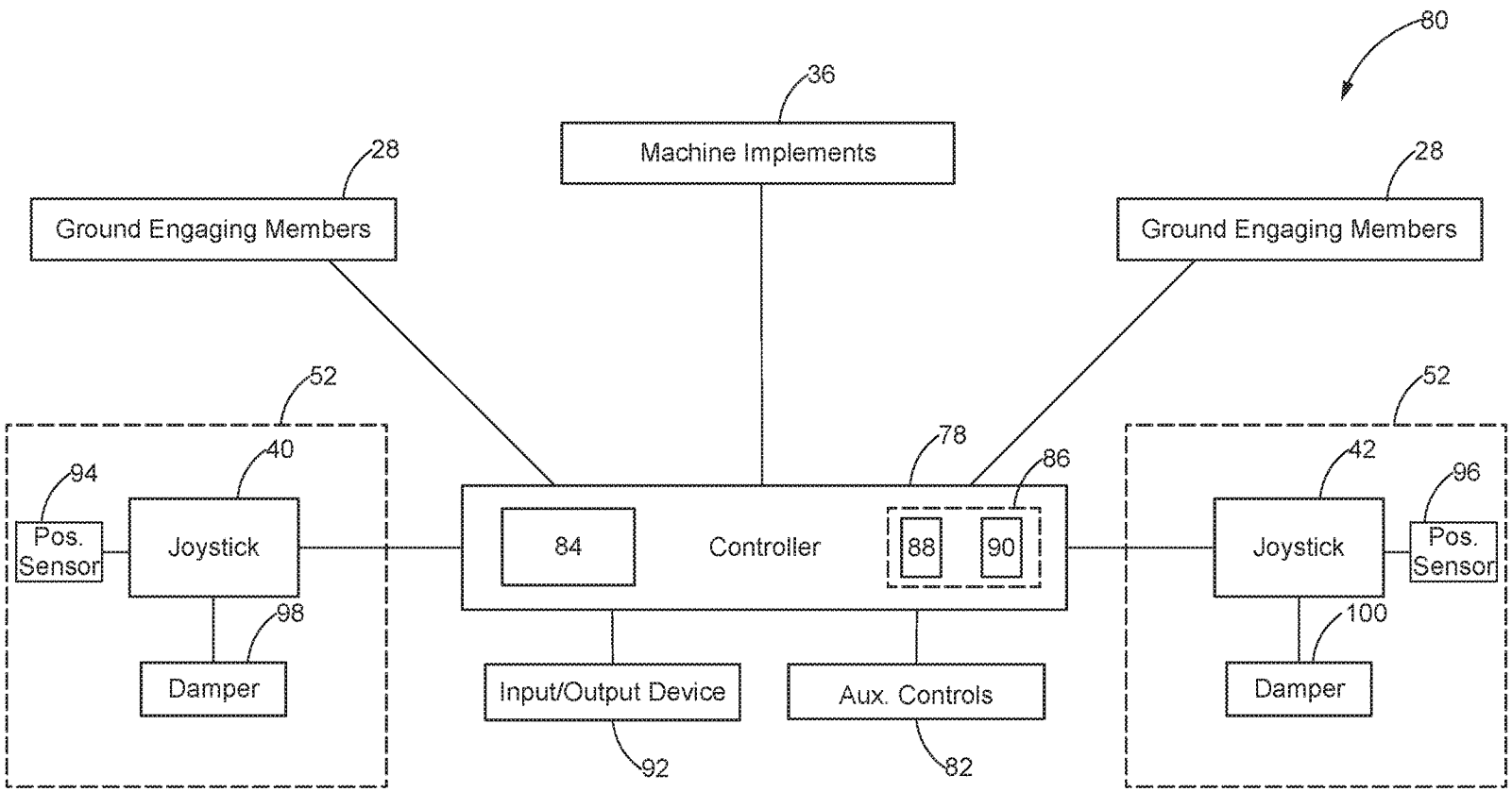
FIG. 5 is a block diagram of an electronic control system for controlling movement of the work machine of FIG. 1, in accordance with an embodiment of the disclosure.

Referring now to FIG. 5, with continued reference to FIGS. 1-4, the work machine 20 may include an electronic control system 80 configured to provide control of two electronic joystick assemblies 52, the ground engaging members 28, the machine implement 36, auxiliary controls 82, such as the first and second pedals 48, 50, and various other components of the work machine 20. The electronic control system 80 may include an electronic controller 78 programmed to receive data signals and other information from input devices, such as, the joystick position sensors 72, and other components and input devices of the work machine 20. The electronic controller 78 may be further configured to process the data signals and other information using software stored therein, and outputting information and commands to components and devices such as, the MR joystick device 57 (FIG. 5), the ground engaging members 28, the machine implement 36 and other output devices.

The electronic controller 78 may include a microprocessor 84 for executing software or other programs that control and monitor the various functions of the work machine 20. Moreover, the microprocessor 84 may include a memory module 86 configured with read only memory (ROM) 88, which provides storage for the software and other data, and random access memory (RAM) 90, which provides storage space for data generated during the execution of the software. While the microprocessor 84 is shown, it will be appreciated that other components, such as, but not limited to, a microcontroller, an application specific integrated circuit (ASIC), or other electronic controlling device.

The electronic controller 78 may be housed within the operator cab 26 (FIG. 2) and further be coupled to an input/output device 92, such that an operator of the work machine 20 can access the electronic controller 78. The input/output device 90 may be configured to allow the operator to input or execute commands through a keyboard, a mouse, a dial, a button, a joystick, a touch screen, a microphone, or other known input device. Additionally, data and other information provided by the electronic controller 78 may be output to a display device such as, a monitor, a speaker, a video screen, or other visual/audio display device that is capable of providing information output by the electronic controller 78 to the operator. In some embodiments, the input/output device 90 may be coupled to the electronic controller 78 through a wired connection. Alternatively, the input/output device 90 may be coupled to the electronic controller 78 through a wireless communication network such as a Bluetooth network, a near-field communication network, a radio frequency communication network, a computer data network, a Wi-Fi data network, a cellular data network, a satellite data network, or other such data communication network. Furthermore, the input/output device 90 may be a handheld mobile device that is wirelessly connected to the electronic controller 78, such as, a tablet computer, a smart phone, a cellular phone, or other such mobile device. As a result, the operator and the input/output device 90 may be remotely located from the electronic controller 78 such that the operator can remotely control the work machine 20 from a location other than the operator cab 26 (FIG. 2).

The electronic control system 80 may be configured to control each electronic joystick assembly 52 when the first and second joysticks 40, 42 are actuated to provide movement of the work machine 20. In some embodiments, the electronic control system 80 may be programmed to provide a release and hold function of the two electronic joystick assemblies 52. For example, the electronic control system 80 may be configured to maintain the positioning of one of the first and second joysticks 40, 42 when the first and second joysticks 40 42 are actuated to move the work machine 20.

To control the positioning of the first and second joystick 40, 42 of each electronic joystick assembly 52, the electronic controller 78 may be configured to monitor the position of the first and second joysticks 40, 42. In one embodiment, the first joystick 40 is coupled to a first position sensor 94 and the second joystick 42 is coupled to a second position sensor 96. As the first and second joysticks 40, 42 are actuated, the first and second position sensors 94, 96 monitor the position of the first and second joysticks 40, 42, and transmit a position signal to the electronic controller 78. The electronic controller 78 receives the position signal and transmits a resistive force signal, based on the received position signals, to a first MR joystick device 98 coupled to the first joystick 40 and a second MR joystick device 100 coupled to the second joystick 42. The resistive force signal may be a magnetic field that is configured to act on one of the first and second MR joystick devices 98, 100 to produce the resistive force that acts on the first and second joysticks 40, 42 to retain one of the first and second joysticks 40, 42 in the operational position (i.e., joystick forward position 74, joystick rearward position 76).

For example, in one embodiment, when the operator applies the actuating force on each electronic joystick assembly 52, the first and second joysticks 40, 42 are actuated from the joystick center position 70 to the joystick forward position 74 to propel the work machine 20 in a straight forward direction of travel (as shown in FIG. 4). As the first and second joysticks 40, 42 are moved, or otherwise actuated, by the actuation force, the first and second position sensors 94, 96 monitor the position and transmit a position signal from the first and second joysticks 40, 42 to the electronic controller 78. In response to the received position signal received from the first and second position sensors 94, 96, the electronic controller 78 may transmit a resistive force signal to one of the first and second MR joystick devices 98,100. The resistive force signal may activate one of the first and second MR joystick devices 98, 100 to generate a resistive force on one of the first and second joysticks 40, 42. As a result, with the first and second joysticks 40, 42, maintained in the joystick forward position 74 the actuating force can be removed from one of the first and second joysticks 40, 42 and the resistive force will retain the released joystick of the first and second joystick 40, 42 in the joystick forward position 74 as long as the operator maintains the other joystick of the first and second joysticks 40, 42 in the joystick forward position 74.

Furthermore, the electronic controller 78 may use the transmitted position signal by the first and second position sensors 94, 96 to assign or otherwise designate one of the first and second joysticks 40, 42 as the primary joystick and the other of the first and second joysticks 40, 42 as the secondary joystick. Application of the actuation force to the first and second joysticks 40, 42 will move the first and second joysticks 40, 42 from the joystick center position 70 to the joystick forward position 74. The electronic controller 78 may be further programmed to designate one of the first and second joysticks 40, 42 as the primary joystick and the other of the first and second joysticks 40, 42 as the secondary joystick based on the received position signal from each of the first and second position sensors 94, 96. In one non-limiting example, the electronic controller 78 designates the first joystick 40 as the primary joystick and the second joystick 42 as the secondary joystick. As a result, the electronic controller 78 may be programmed to transmit the resistive force signal to the secondary joystick to and the second MR joystick device 100 may generate the resistive force and retain the second joystick 42 (i.e., secondary joystick) in the joystick forward position 74, so long as the operator maintains the first joystick 40 (i.e., primary joystick) in the joystick forward position 74.

Alternatively, the electronic control system 80 may be configured to monitor the direction that each of the first and second joysticks 40, 42 move. As such, the resistive force may be configured to control movement of the first and second joysticks 40, 42 which favors, or otherwise biases, travel of the work machine 20 in a straight direction. For example, application of the actuation force to only the first joystick 40 will move the first joystick 40 from the joystick center position 70 towards the joystick forward position 74 and the second joystick 42 will remain in the joystick center position 70. The electronic controller 78 may be programmed to designate the first joystick 40 as the primary joystick and the second joystick 42 as the secondary joystick based on the received position signal from each of the first and second position sensors 94, 96. Furthermore, the electronic controller 78 may be configured to transmit the resistive force signal to activate the second MR resistive force signal such that a subsequent application of the actuating force to move the secondary joystick from the joystick center position 70 to the joystick forward position 74 generates the resistive force to exhibit low resistance against movement of the secondary joystick from the joystick center position 70 towards the joystick forward position 74 and a high resistance against movement of the secondary joystick from the joystick forward position 74 towards the joystick center position 70.

The electronic controller 78 may additionally be electrically coupled to the auxiliary controls 82, such as the first and second pedals 48, 50 (FIG. 2), and the electronic controller 78 may transmit and receive control signals related to the control and operation of the machine implement 36 attached to the work machine 20. For example, the electronic controller 78 may be electrically coupled to the actuating cylinders 32 of the lift arm 30 and the electronic controller 78 may send control signals which correspond to movements of the auxiliary controls 82, and cause the actuating cylinders 32 to extend, retract, or other such actuation.

INDUSTRIAL APPLICABILITY

In general, the foregoing disclosure finds utility in various industrial applications, such as in earthmoving, construction, landscaping, transportation, forestry, agriculture, and mining machines. In particular, the disclosed control system may be applied to loaders, excavators, earth-moving vehicles, tractors, motor graders, dozers, backhoes, hauling machines, dump trucks, mining vehicles, on-highway vehicles, trains, agricultural equipment, material handling equipment, and the like.

Figure 6:
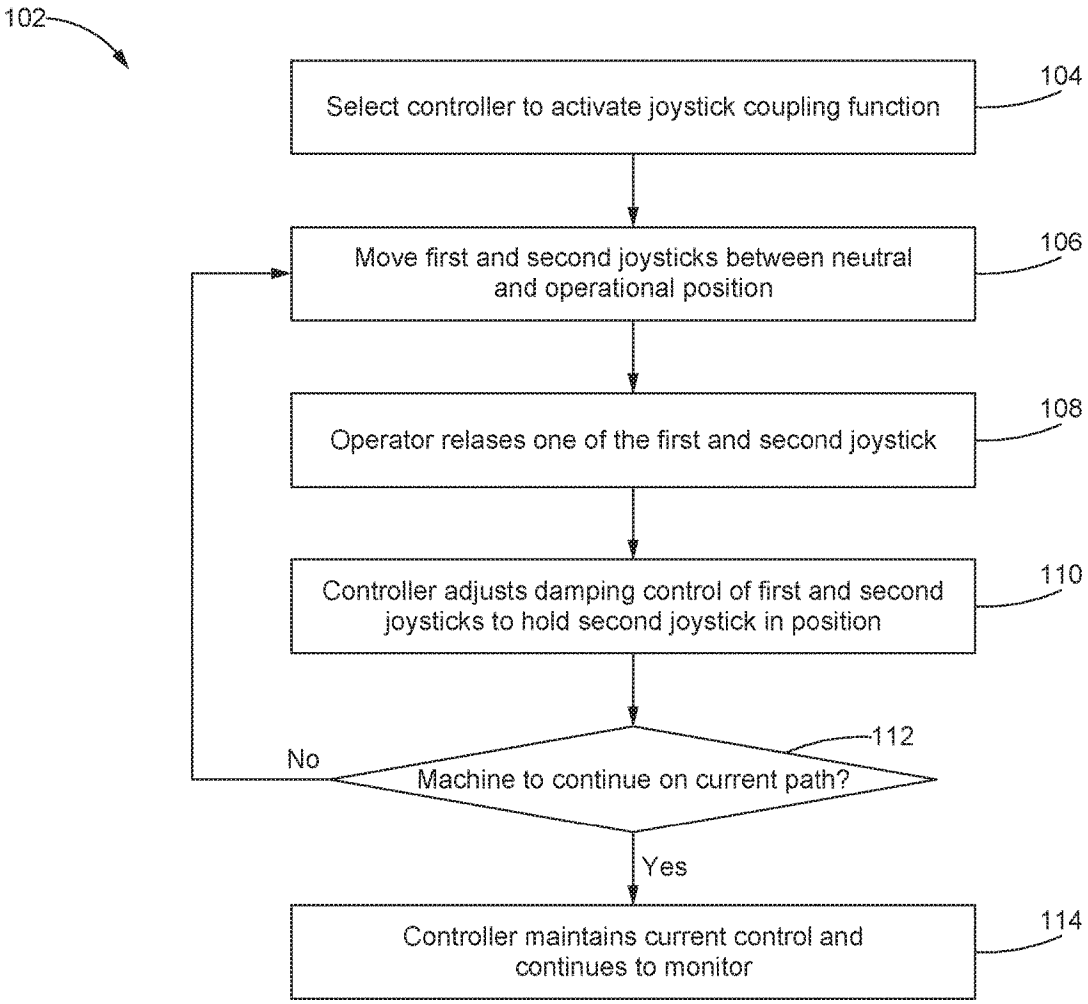
FIG. 6 is a flowchart illustrating a method of controlling movement of the work machine of FIG. 1, in accordance with an embodiment of the disclosure.

Referring now to FIG. 6, with continued reference to FIGS. 1-5, a method 102 for controlling movement of the work machine 20 is illustrated. In some embodiments, the work machine 20 includes an electronic control system 80 that is capable of controlling the movement and operation of one or more electronic joystick assemblies 52 integrated into the work machine 20. Moreover, the electronic control system 80 may be configured to be selectively operated such that an operator of the work machine 20 may choose to activate and/or deactivate one or more operational modes, such as coupling multiple electronic input devices while operating the work machine 20.

In one non-limiting example, the electronic control system 80 of the work machine 20 is configured to provide an electronic coupling of two electronic joystick assemblies 52 of the work machine 20. To activate the electronic coupling of the two electronic joystick assemblies 52, in a first block 104 of the method 102, the operator selects the electronic controller 78 to activate the joystick coupling function. The electronic coupling of the two electronic joystick assemblies 52 (i.e., first and second joysticks 40, 42) may allow the operator of the work machine 20 to move the two electronic joystick assemblies 52, with one electronic joystick assembly 52 having a first joystick 40 and the other electronic joystick assembly 52 having a second joystick 42. Following activation of the electronic coupling of the two electronic joystick assemblies 52, the electronic control system 80 may be able to maintain position of the first and second joysticks 40, 42 as long as the operator maintains control of one of the first and second joysticks 40, 42.

Once the joystick coupling function is activated on the electronic controller 78, then in a next block 106, the operator may be able to engage the joystick coupling function by applying an actuation force to move the first and second joysticks 40, 42 between the joystick center position 70 (i.e., joystick neutral position) and the joystick forward position 74 (i.e., joystick operational position). Alternatively, the operator may engage the joystick coupling function by applying the actuation force to move the first and second joysticks 40, 42 between the joystick center position 70 and the joystick rearward position 76 (i.e., joystick operational position). When the first and second joysticks 40, 42 are moved between the joystick neutral position and the joystick operational position, a position signal may be transmitted to the electronic controller 78 from a first position sensor 94 coupled to the first joystick 40 and a second position sensor 96 coupled to the second joystick 42. Moreover, the electronic control system 80 may be configured such that, based on the position signal received from the first and second position sensors 94, 96, the electronic controller 78 transmits a resistive force signal to one of the first and second MR joystick devices 98, 100 which are coupled to the first and second joysticks 40, 42.

In a next block 108, the operator may choose to remove the actuation force from one of the first and second joysticks 40, 42 when they are in the operational position. The first and second joysticks 40, 42 may be configured to each have a joystick centering spring 68 which produces a joystick return force. Generally, when the operator of the work machine 20 removes the actuation force on the first and/or second joystick 40, 42, the joystick return force actuates the first and/or second joystick 40, 42 to move back toward the joystick neutral position from the joystick operational position. However, when the joystick coupling function is activated, the electronic controller 78 may provide control over the first and second MR joystick devices 98, 100 to generate a resistive force on one of the first and second joysticks 40, 42. As a result, in a next block 110, when the operator releases one of the first and second joysticks 40, 42, the resistive force generated by one of the first and second MR joystick devices 98 100, may be configured to be greater than the return spring force of the joystick centering spring 68. Additionally, the resistive force may be configured to act in an opposite direction as the return spring force and therefore may be capable of maintaining one of the first and second joystick 40, 42 in the joystick operational position (i.e., joystick forward position 74, joystick rearward position 76), as long as the other joystick of the first and second joysticks 40, 42 is maintained in the joystick operational position (i.e., joystick forward position 74, joystick rearward position 76).

The resistive force generated by the second MR joystick device 100 may maintain the second joystick 42 in the joystick operational position (i.e., joystick forward position 74 or joystick rearward position 76), as long as the first joystick 40 is maintained in the joystick forward position 74 or joystick rearward position 76 by the operator. However, in a next block 112 the operator of the work machine 20 may make a decision of whether to keep the work machine 20 headed on its current path or whether adjustments to the travel path of the work machine 20 are needed. If the operator decides to maintain the current path, then in a next block 114, the electronic control system 80 maintains the control over the first and second joysticks 40, 42. The operator retains control over the first joystick 40 in the joystick forward position 74 or joystick rearward position 76. The electronic controller 78 continues transmitting the resistive force signal to the second MR joystick device 100 such that the resistive force continues to be applied and maintains the second joystick 42 in the joystick forward position 74 or the joystick rearward position 76.

On the other hand, if in block 112 the operator decides to change the current path of the work machine 20 then movement of the first joystick 40 and/or the second joystick 42 between the joystick center position 70 and the joystick forward position 74 or the joystick rearward position 76 may deactivate the joystick coupling function of the electronic control system 80. In some embodiments, the resistive force signal being transmitted by the electronic controller 78 to the second MR joystick device 100 will decrease the resistive force being applied to the second joystick 42. The resistive force may be decreased to an amount where the return spring force generated by the joystick centering spring 68 of the second joystick 42 overcomes the resistive force and returns the second joystick 42 to the joystick center position 70. Additionally or alternatively, the operator may move and adjust the first and/or second joysticks 40, 42 to control and operate the work machine 20 to carry out the desired task.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto. Moreover, while some features are described in conjunction with certain specific embodiments, these features are not limited to use with only the embodiment with which they are described, but instead may be used together with or separate from, other features disclosed in conjunction with alternate embodiments.

What is claimed is:

1. An electronic control system for controlling movement of a work machine, the electronic control system comprising:

a first joystick configured to move between a neutral position and an operational position about a first axis, the first joystick further configured to transmit a first joystick position signal;

a first resistive device operatively coupled to the first joystick and configured to generate a resistive force about the first axis to selectively retain the first joystick in the operational position in response to a first resistive force signal;

a second joystick configured to move between a neutral position and an operational position about a second axis, the second joystick further configured to transmit a second joystick position signal;

a second resistive device operatively coupled to the second joystick and configured to generate a resistive force about the second axis to selectively retain the second joystick in the operational position in response to a second resistive force signal; and an electronic controller in electronic communication with the first and second joysticks and the first and second resistive devices, the electronic controller configured to receive the first and second joystick position signals and transmit one of the first and second resistive force signal in response to the first and second joystick position signals, wherein the transmitted one of the first and second resistive force signal activates one of the first and second resistive devices to generate the resistive force such that one of the first and second joysticks is retained in the operational position.

2. The electronic control system of claim 1, wherein the first joystick having a first centering spring configured to exert a first return spring force to return the first joystick from the operational position to the neutral position, the second joystick having a second centering spring configured to exert a second return spring force to return the second joystick from the operational position to the neutral position, and the resistive force generated by one of the first and second resistive devices being configured to be greater than one of the first return spring force and the second return spring force such that one of the first and second joysticks is retained in the operational position.

3. The electronic control system of claim 2, wherein the first resistive device is a first magnetorheological device and the second resistive device is a second magnetorheological device, the first and second resistive force signals comprise a magnetic field applied to one of the first and second magnetorheological devices to generate the resistive force, and the resistive force being configured to oppose at least one of the first return spring force and the second return spring force.

4. The electronic control system of claim 3, further comprising a first position sensor operatively coupled to the first joystick and a second position sensor operatively coupled to the second joystick, the first position sensor configured to provide the first position signal and the second position sensor configured to provide the second position signal, and the electronic controller being further configured to use the first and second position signals to designate one of the first joystick and the second joystick as a primary joystick and one of the first joystick and the second joystick as a secondary joystick.

5. The electronic control system of claim 4, wherein an actuating force applied to each of the primary joystick and the secondary joystick moves the primary and secondary joysticks from the neutral position to the operational position, and the first and second resistive force signals transmitted by the electronic controller adjust the second magnetorheological device such that so long as the actuating force maintains the primary joystick in the operational position the resistive force maintains the secondary joystick in the operational position following removal of the actuating force from the secondary joystick.

6. The electronic control system of claim 5, wherein removal of the actuating force applied to the primary joystick moves the primary joystick from the operational position to the neutral position, and the first and second resistive force signals transmitted by the electronic controller control the second magnetorheological device such that the resistive force applied to the secondary joystick is reduced and the secondary joystick moves from the operational position to the neutral position.

7. The electronic control system of claim 5, wherein when the actuating force applied to the primary joystick moves the primary joystick from the neutral position to the operational position and maintains the primary joystick in the operational position, the actuating force not being applied to the secondary joystick such that the secondary joystick remains in the neutral position, the first and second resistive force signals transmitted by the electronic controller activate the second magnetorheological device such that a subsequent application of the actuating force to move the secondary joystick from the neutral position to the operational position produces the resistive force having a low resistance against movement of the secondary joystick from the neutral position towards the operational position and a high resistance against movement of the secondary joystick from the operational position towards the neutral position.

8. A work machine, comprising:

a frame;

a power source supported by the frame;

a plurality of ground engaging members configured to support the frame, the ground engaging members operatively coupled to the power source and configured to move the work machine;

an electronic control system operatively coupled to the plurality of ground engaging elements for controlling a movement of the work machine, the electronic control system including;

a first joystick configured to move between a neutral position and an operational position about a first axis the first joystick further configured to transmit a first joystick position signal;

a first resistive device operatively coupled to the first joystick and configured to generate a resistive force about the first axis to selectively retain the first joystick in the operational position in response to a first resistive force signal;

a second joystick configured to move between a neutral position and an operational position about a second axis, the second joystick further configured to transmit a second joystick position signal;

a second resistive device operatively coupled to the second joystick and configured to generate a resistive force about the second axis to selectively retain the second joystick in the operational position in response to a second resistive force signal; and an electronic controller in electronic communication with the first and second joysticks and the first and second resistive devices, the electronic controller configured to receive the first and second joystick position signals and transmit one of the first and second resistive force signal in response to the first and second joystick position signals, wherein the transmitted one of the first and second resistive force signal activates one of the first and second resistive devices to generate a resistive force such that one of the first and second joysticks is retained in the operational position.

9. The work machine of claim 8, wherein the first joystick having a first centering spring configured to exert a first return spring force to return the first joystick from the operational position to the neutral position, the second joystick having a second centering spring configured to exert a second return spring force to return the second joystick from the operational position to the neutral position, and the resistive force generated by one of the first and second resistive devices being configured to be greater than one of the first return spring force and the second return spring force such that one of the first and second joysticks is retained in the operational position.

10. The work machine of claim 9, wherein the first resistive device is a first magnetorheological device and the second resistive device is a second magnetorheological device, the first and second resistive force signal comprise a magnetic field applied to one of the first and second magnetorheological devices to generate the resistive force, and the resistive force being configured to oppose at least one of the first return spring force and the second return spring force.

11. The work machine of claim 10, further comprising a first position sensor operatively coupled to the first joystick and a second position sensor operatively coupled to the second joystick, the first position sensor configured to provide the first position signal and the second position sensor configured to provide the second position signal, and the electronic controller being further configured to use the first and second position signals to designate one of the first joystick and the second joystick as a primary joystick and one of the first joystick and the second joystick as a secondary joystick.

12. The work machine of claim 11, wherein an actuating force applied to each of the primary joystick and the secondary joystick moves the primary and secondary joysticks from the neutral position to the operational position, and the first and second resistive force signals transmitted by the electronic controller adjust the second magnetorheological device such that so long as the actuating force maintains the primary joystick in the operational position the resistive force maintains the secondary joystick in the operational position following removal of the actuating force from the secondary joystick.

13. The work machine of claim 12, wherein removal of the actuating force applied to the primary joystick moves the primary joystick from the operational position to the neutral position, and the first and second resistive force signals transmitted by the electronic controller control the second magnetorheological device such that the resistive force applied to the secondary joystick is reduced and the secondary joystick moves from the operational position to the neutral position.

14. The work machine of claim 12, wherein when the actuating force applied to the primary joystick moves the primary joystick from the neutral position to the operational position and maintains the primary joystick in the operational position, the actuating force not being applied to the secondary joystick such that the secondary joystick remains in the neutral position, the first and second resistive force signals transmitted by the electronic controller activate the second MR device such that a subsequent application of the actuating force to move the secondary joystick from the neutral position to the operational position produces the resistive force having a low resistance against movement of the secondary joystick from the neutral position towards the operational position and a high resistance against movement of the secondary joystick from the operational position towards the neutral position.

15. A method of controlling movement of a work machine, the method comprising:

applying an actuating force to a first joystick about a first axis and a second joystick about a second axis thereby moving the first and second joysticks from a neutral position to an operational position;

transmitting a first joystick position signal from the first joystick and a second joystick position signal from the second joystick to an electronic controller;

receiving by the electronic controller the first joystick position signal and the second joystick position signal and transmitting a first resistive force signal to a first resistive device and a second resistive force signal to a second resistive device from the electronic controller in response to the first and second joystick position signals; and activating one of the first and second resistive devices with the resistive force signal to generate a resistive force such that one of the first and second joysticks is retained in the operational position by one of the first and second resistive devices in response to one of the first and second resistive force signals.

16. The method of claim 15, wherein the first joystick includes a first centering spring configured to exert a first return spring force to return the first joystick from the operational position to the neutral position, the second joystick includes a second centering spring configured to exert a second return spring force to return the second joystick from the operational position to the neutral position, and wherein transmitting the resistive force signal comprises activating at least one of the first and second resistive devices comprises generating the resistive force to be greater than at least one of the first return spring force and the second return spring force such that at least one of the first and second joysticks is retained in the operational position.

17. The method of claim 16, wherein the first resistive device comprises a first magnetorheological device, the second resistive device comprises a second magnetorheological device, the resistive force signal comprises a magnetic field and applying the magnetic field comprises generating the resistive force of the second resistive device to act in an opposite direction than the second return spring force.

18. The method of claim 17, wherein the first joystick includes a first position sensor in electronic communication with the electronic controller providing a first joystick position between the neutral position and the operational position, the second joystick includes a second position sensor in electronic communication with the electronic controller providing a second joystick position between the neutral position and the operational position and using the first joystick position and the second joystick position to designate the first joystick as a primary joystick and the second joystick as a secondary joystick.

19. The method of claim 18, wherein applying the actuating force to each of the primary joystick and the secondary joystick moves the primary and secondary joysticks from the neutral position to the operational position, and transmitting the second resistive force signal activates the second magnetorheological device such that the resistive force maintains the secondary joystick in the operational position following the removal of the actuating force from the secondary joystick so long as the actuating force maintains the primary joystick in the operational position.

20. The method of claim 19, wherein removing the actuating force from the primary joystick moves the primary joystick from the operational position to the neutral position and transmitting the resistive force signal controls the second magnetorheological device such that the resistive force applied to the secondary joystick is reduced and the secondary joystick moves from the operational position to the neutral position.

* * * * *